US005551323A

United States Patent [19]

Beere et al.

[11] Patent Number: 5,551,323

[45] Date of Patent: Sep. 3, 1996

[54] SCREWDRIVER HANDLE

[75] Inventors: Richard F. Beere, Waterford; Guy L. Bradshaw, Kenosha, both of Wis.

[73] Assignee: Beere Precision Medical Instruments, Inc., Racine, Wis.

[21] Appl. No.: 408,533

[22] Filed: Mar. 22, 1995

[51] Int. Cl.[6] ..... B25G 1/01

[52] U.S. Cl. ..... 81/489; 81/177.6; 81/900

[58] Field of Search ..... 81/489, 177.1, 81/177.6, 900

[56] References Cited

U.S. PATENT DOCUMENTS

| | | | |
|---|---|---|---|
| D. 307,236 | 4/1990 | Cascio et al. | D8/82 |
| D. 309,246 | 7/1990 | Cascio et al. | D8/82 |
| 2,871,899 | 2/1959 | Coyle et al. | 145/61 |
| 3,189,069 | 6/1965 | Stowell | 81/177.1 |
| 3,340,914 | 9/1967 | Ricks | 145/61 |
| 3,343,577 | 9/1967 | Wagner | 81/177.1 |
| 3,438,413 | 4/1969 | Borah | 145/50 |
| 4,147,443 | 4/1979 | Skobel | 403/267 |
| 4,452,289 | 6/1984 | Smith | 81/177.1 |
| 4,621,718 | 11/1986 | DeCarolis | 192/43 |
| 4,729,271 | 3/1988 | Kenigson | 81/177.1 |
| 4,739,536 | 4/1988 | Bandera et al. | 81/177.6 |
| 4,777,852 | 10/1988 | Herman et al. | 91/63.1 |
| 4,974,286 | 12/1990 | Stowell et al. | 16/11 R |
| 5,042,804 | 8/1991 | Uke et al. | 81/489 |
| 5,052,253 | 10/1991 | Lin | 81/489 |
| 5,359,911 | 11/1994 | Kruesi | 81/900 |
| 5,390,572 | 2/1995 | Gakhar et al. | 81/900 |

FOREIGN PATENT DOCUMENTS

| | | | |
|---|---|---|---|
| 2635998 | 3/1990 | France | 81/177.1 |
| 2275014 | 8/1994 | United Kingdom | 81/177.1 |

*Primary Examiner*—Willis Little
*Attorney, Agent, or Firm*—Arthur J. Hansmann

[57] ABSTRACT

A screwdriver handle product and method of making same, where a solid core piece has an elastomer cover molded thereon, and the core piece has grooves for receiving the molten cover to thus have the cover secure on the core piece. The cover is shaped in cross-section to present corners, for enhancing the control and grip of the handle, and also the exterior of the cover is dimpled or of a roughened surface for further enhancement of grip of the handle.

3 Claims, 1 Drawing Sheet

SCREWDRIVER HANDLE

This invention relates to a screwdriver handle and method of making same. Particularly, the handle of this invention is specifically adapted for screwdrivers used in surgery, such as in the turning of screws in a skeletal system.

BACKGROUND OF THE INVENTION

The prior art is already aware of screwdriver handles of various materials, shapes, and methods of manufacturing same. For instance, see the disclosures of the shape of screwdriver handles in U.S. Pat. No. Des. 307,236 and U.S Pat. No. Des. 309,246 and in U.S. Pat. No. 4,621,718 and U.S. Pat. No. 4,777,852.

The present invention differs from the foregoing in that it pertains to a screwdriver handle which has an elastomer cover thereover, namely, a silicone rubber cover. Again, the prior art does contain disclosures of tool handles which have elastomer covers, such as shown in U.S. Pat. No. 2,871,899 and U.S. Pat. No. 3,340,914 and U.S. Pat. No. 3,438,413 and U.S. Pat. No. 4,621,718 and U.S. Pat. No. 4,974,286, for instance, which differ from this invention.

The present invention differs from the prior art in that it has a unique arrangement for attaching the elastomer cover to a solid piece core, and it presents a unique configuration in its cross-section, and the exterior of the elastomer cover is unique and the cover itself is made of a silicone rubber which has been found to be particularly suitable for surgical implements.

Accordingly, the present invention improves upon the prior art by providing a tool handle, such as a surgical screwdriver, which has an arrangement for physically attaching the elastomer cover to a core piece without the need for cement. The arrangement is such that the cross-sectional configuration of the elastomer cover presents corners of the handle and thereby enhances the feel and grip on the handle,and such enhancement is also in conjunction with having the surface of the elastomer cover of a dimpled or pockmarked arrangement so that it is irregular and further enhances security of the user's hand grip thereon.

As such, the implement handle of this invention can have an elastomer cover applied as a part of the handle, but not utilize cement or other foreign material for securing the cover to an underneath solid core piece. Further, the elastomer cover of this invention is capable of withstanding autoclaving at pressures and temperatures which would normally deteriorate other elastomer materials, but, in this arrangement, the handle of this invention can withstand repeated sterilization without noticeable deterioration.

The invention accordingly relates to both the product of the handle itself and to the method for making the handle by a molding process to achieve the aforementioned benefits and advantages.

DETAILED DESCRIPTION OF THE PREFERRED PRODUCT AND METHOD

Figures 1, 2, 3, 4, 5, 6, 7, 8, 9, 10:
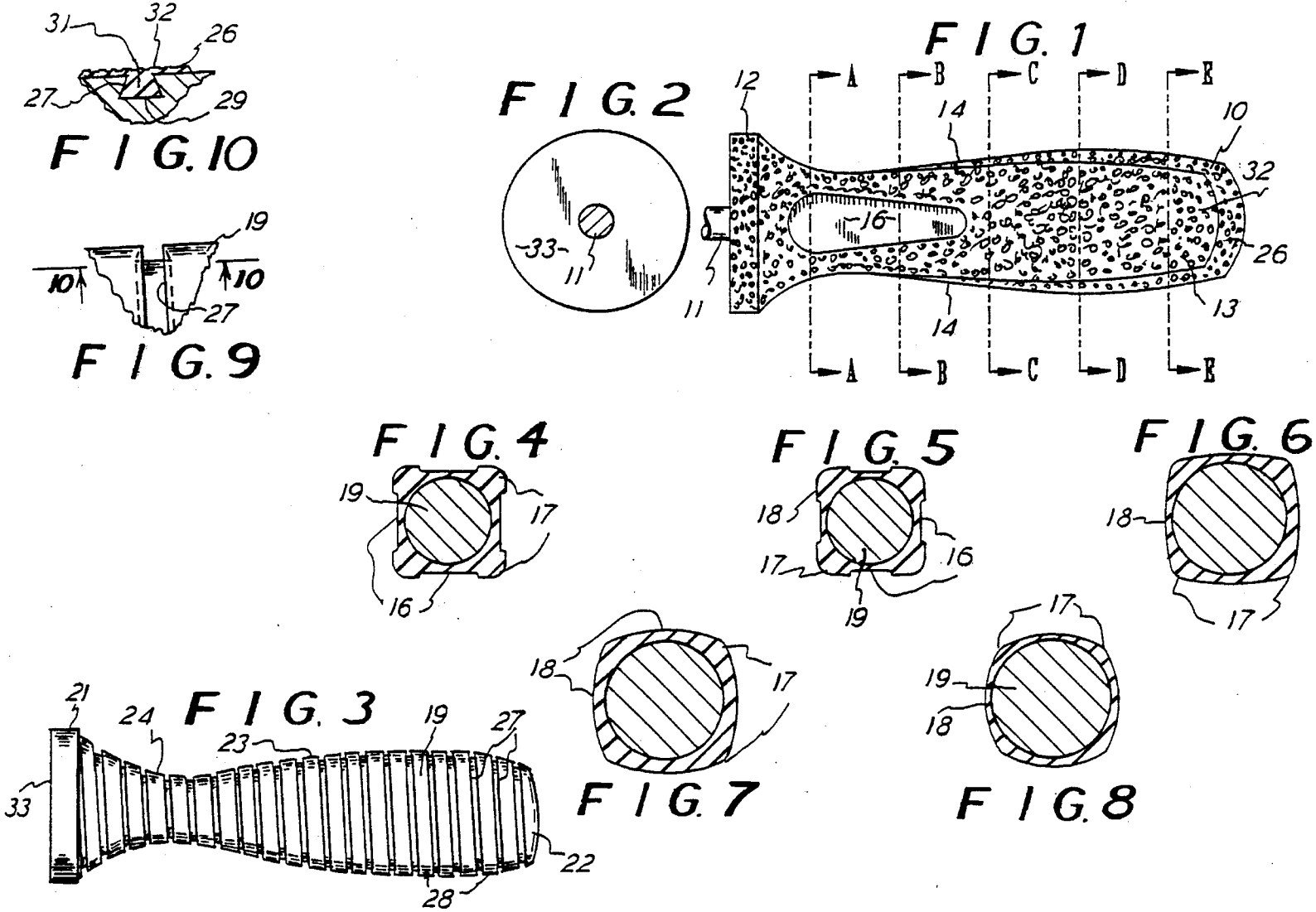
FIG. 1 is a side elevational view of a screwdriver handle of this invention.
FIG. 2 is a left end elevational view of FIG. 1.
FIG. 3 a side elevational view, similar to FIG. 1, but showing only the core piece without the cover thereover.
FIG. 4 through 8 are sectional views taken respectively along the planes designated A—A through E—E.
FIG. 9 is an enlarged side elevational view of a fragment of FIG. 3.
FIG. 10 is a sectional view taken along the line 10—10 of FIG. 9.

The following description refers to the drawings, and the method of making the screwdriver handle is also inherent in the disclosure of this description, including the drawings.

FIG. 1 shows the side view of the handle generally designated 10 and it has the elongated shape extending left to right as viewed in FIG. 1 and along the axis of the fragment of the screwdriver bit 11. As mentioned, the handle of this invention is particularly suitable for use in surgical proceedings, and it is also particularly susceptible to sterilization, such as being subjected to cleansing chemicals or to heat and pressure, all without deteriorating the handle to any noticeable degree. The screwdriver has the cylindrical portion 12 and the elongated substantially cylindrical portion 13 which has the compound curvature along the silhouette lines designated 14. A small fraction of the exterior surface of the handle 10 has four depressions 16, as shown in FIG. 1 and as revealed in FIGS. 4 and 5.

The handle 10 is four-sided, and that feature is shown in the section views 4 through 8, and thus four corners 17 are formed on the exterior of the handle, as described hereinafter. Two adjacent corners 17 flank one side designated 18 and with the side 18 shown in FIGS. 4 through 8 to be of different external configurations, but extending between every two corners 17.

FIG. 3 further emphasizes the aforementioned arrangement of sides and corners in that FIG. 3 shows a rigid or solid core piece 19 which is elongated from left to right, as viewed in FIG. 3, and which has its circular end 21 and its butt end 22. Again, the core piece has the compound curvature on the upper and lower silhouette thereof, and generally along the lines designated 23 on the convex curvature and lines 24 on the concave curvature. That is, the core piece 19 is on the inside of the handle 10 seen in FIG. 1. The core piece 19 has an elastomer cover 26 extending completely thereover, as seen in FIG. 1 and FIGS. 4 through 8. That is, the core piece 19 is of a rigid material, such as aluminum, and it therefore resists the force of hand gripping, but the complete exterior of the core piece 19 is encapsulated by the elastomer cover 26 which is a silicone rubber material. This material is a two-component cured silicone rubber compound with one component A containing a proprietary platinum catalyst in a network of short and relatively long chains of polydimethylsiloxane and vinylmethylpolysiloxane in a reinforcing silica filler matrix. The component B contains a hydrogen functional polysiloxane crosslinking agent also in a network of short and relatively long chains of polydimethylsiloxane and vinylmethylpolysiloxane in a reinforcing silica filler network. The components A and B are mixed in equal proportions on a two roll mill. Vulcanization occurs as a result of hydrosilylation between the vinyl groups of the polymer, and the SiH functional crosslinking agent. The reaction is catalyzed by the platinum agent present in component A. This is the silicone rubber definition in this specification and it is the ElastoSil product registered trademark of Wacker Silicones Corporation in Adrian, Mich.

The cover 26 is applied to the core piece 19 in a molding process and of course in molten form to where it hardens to a rubbery condition which adheres to the core 19. In the molding process, the elastomer is caused to flow into grooves 27 extending around and throughout the length of the core piece 19, as shown in FIG. 3. For drawing simplicity, these grooves are not shown in the section views 4 through 8, though of course they would be there as shown in enlarged FIG. 10. As seen in FIG. 3, the groove 27 is actually one continuous spiral groove from the butt end 22 to the head or cylindrical end 21, and the width of the grooves 27 is approximately one third of the lands designated 28 and extending circularly between every two grooves 27. Thus, in the total length of the core piece 19, and that may be a length of approximately 4 inches, there are twenty grooves 27 seen on each of the side elevational view of the core piece 19. FIGS. 9 and 10 show enlarged views of a fragment of the piece 19 and those views particularly show the grooves 27 which are shown to be undercut so that the groove base 29 is wider than the opening of the groove at the curved surfaces 23 and 24, as particularly seen in FIG. 10. Thus, the molten cover material 26 will flow into the groove 27 and fill the groove so that the undercut or wedged-shape groove 27 will trap the portion 31 of the cover material 26 in the groove 27. With that arrangement, the cover 26 is secured to the core piece 19 without the need of cement or the like. Thus, the cover 26 is completely secure and stable on the core 19 and the user can hand grip the cover 26 and apply rotation torque without having the cover 26 slip relative to the core piece 19 since the two become integral by means of the grooving 27 and particularly the undercut or extended dimension 29 of the groove 27 and the complete filling of the groove 27 by means of the cover material at 31.

Also, as previously mentioned and as shown in the drawings, even though the core piece 19 is circular in all its cross sections along its length, as seen in FIGS. 4 through 8, the cover piece is molded and configured to present the four corners 17 and the four intervening sides 18, all for enhancing the control and grip of the handle.

Additionally, the exterior surface of the cover 26 is dimpled or irregular, as seen at 32 in FIG. 10 and also as shown in FIG. 1 by the irregular markings on FIG. 1 to indicate the dimpling over the entire cover 26 except for the portion at 16 which is a depression and which is smooth and can serve as a thumb placement depression for the user's hand. As shown, depressions 16 extend only in the handle length one-half at the handle end which is adjacent the tool 11 and only in the direction longitudinal of the length of the handle itself.

Thus the term "dimpling" or "dimpled" means a roughened surface as described and as shown herein, and it enhances the frictional coefficient between the user's grip and cover 26, and it provides for an extremely comfortable grip which renders the user confident in using the screwdriver. Accordingly, FIG. 10 shows that the depth of recesses of the dimpling is less than the width of the land at 32, so the depth is only shallow, for grip and sterilization purposes. Actually, the face portion 33 of the handle as seen in FIG. 2, would not necessarily include the roughened or dimpled surface, but that could be a smooth surface and in fact it could be free of the material in the cover 26 and it could in essence be the end of the core piece 19.

The method of making this handle in inherent in the afore-mentioned description, and it will be further understood that the core piece 19 is placed into a mold and the silicone rubber is injected into the mold so that it flows into the grooves 27 and completely encapsulates the core piece 19, as shown and described. Further, in the molding process, the four corners 17 are formed by the cover material in cover 26, even though the core piece 19 is only completely circular in its cross section, and the corners 17 further enhance the control and grip of the handle.

The dimpling or roughened cover exterior 32 is arranged so that the outermost plane of the cover 26 constitutes sixty per-cent of the cover's exterior surface while the depression or dimpling is the remainder forty per-cent of the cover's exterior. Thus the showings of circles or like markings of FIG. 1 show the cover's forty per-cent aspect.

What is claimed is:

1. A screwdriver handle for use in a sterile medical environment, comprising a core piece of a rigid material of a cylindrical shape along a longitudinal axis and being capable of withstanding a user's hand-gripping force without distortion, a cover encapsulating said core piece and being affixed to said core piece and capable of transmitting hand-applied torque to said core piece, said cover being of silicone rubber material molded onto said core piece and extending therealong in the direction of said longitudinal axis and being of a cross-sectional shape on the plane perpendicular to said longitudinal axis to present various thicknesses extending from said core piece, thereby, providing a plurality of corners and sides for enhancement of hand-gripping, said cover having a completely smooth depression on each of said sides and said depressions being elongated in the direction parallel to said axis and being only in the half of said handle adjacent one longitudinal end of said handle, for receiving the user's thumb during hand-gripping, and said cover has a dimpled exterior which extends throughout substantially all of the exterior surface of said cover except for said depressions and said dimpled exterior has recesses and lands and with said recesses being of a depth only less than one-half the width of said lands, for enhancing gripping and sterilization, and said dimpled exterior consists of forty per cent thereof being depressed and the remaining sixty per cent being raised to lie along one outermost plane of said cover's exterior surface.

2. The screwdriver handle for use in a sterile medical environment as claimed in claim 1, wherein said core piece has a single spiral groove extending the entire length of said core piece, and said cover is disposed partly throughout said groove for securing said cover to said core piece.

3. The screwdriver handle for use in a sterile medical environment as claimed in claim 2, wherein said groove is of an under-cut wedge shape which is wider at its base for securely holding onto said cover disposed in said groove.

* * * * *